US008511599B2

(12) United States Patent
Lalau et al.

(10) Patent No.: US 8,511,599 B2
(45) Date of Patent: Aug. 20, 2013

(54) PAPER TOWEL DISPENSING SYSTEMS

(76) Inventors: Richard Lalau, North Vancouver (CA); Damir Wallener, North Vancouver (CA); Lockland Corley, Coquitlam (CA); Andrew Jackman, Langley (CA); Alex Trampolski, Richmond (CA); Matthew Friesen, Surrey (CA)

( * ) Notice: Subject to any disclaimer, the term of this patent is extended or adjusted under 35 U.S.C. 154(b) by 762 days.

(21) Appl. No.: 12/660,765

(22) Filed: Mar. 4, 2010

(65) Prior Publication Data

US 2011/0215188 A1 Sep. 8, 2011

(51) Int. Cl.
*B65H 43/00* (2006.01)
*B65H 20/02* (2006.01)

(52) U.S. Cl.
USPC ..... 242/563; 242/564.4

(58) Field of Classification Search
USPC ..... 242/563, 564, 564.1, 564.3, 564.4, 242/565
See application file for complete search history.

(56) References Cited

U.S. PATENT DOCUMENTS

| | | | |
|---|---|---|---|
| 3,715,085 | A | 2/1973 | Kobayashi et al. |
| 3,730,409 | A | 5/1973 | Ratti |
| 3,737,087 | A | 6/1973 | Rooklyn |
| 3,949,918 | A | 4/1976 | Golner et al. |
| 3,998,308 | A | 12/1976 | Yeakley |
| 4,122,738 | A | 10/1978 | Granger |
| 4,170,390 | A | 10/1979 | McCabe |
| 4,270,818 | A | 6/1981 | McCabe |
| 4,448,196 | A | 5/1984 | Money et al. |
| 4,573,750 | A | 3/1986 | Golby |
| 4,666,099 | A | 5/1987 | Hoffman et al. |
| 4,676,131 | A | 6/1987 | Cassia |
| 4,717,043 | A | 1/1988 | Groover et al. |
| 4,721,265 | A | 1/1988 | Hawkins |
| 4,738,176 | A | 4/1988 | Cassia |
| 4,790,490 | A | 12/1988 | Chakravorty |
| 4,796,825 | A | 1/1989 | Hawkins |
| 4,826,262 | A | 5/1989 | Hartman et al. |
| 4,848,854 | A | 7/1989 | Kennedy |
| 4,960,248 | A | 10/1990 | Bauer et al. |
| 5,131,302 | A | 7/1992 | Watanabe |
| 5,244,263 | A | 9/1993 | Kennedy |
| 5,335,811 | A | 8/1994 | Morand |
| 5,340,045 | A | 8/1994 | Arabian et al. |
| 5,351,685 | A | 10/1994 | Potratz |
| 5,375,920 | A | 12/1994 | Macchi Cassia |
| 5,417,783 | A | 5/1995 | Boreali et al. |
| 5,441,189 | A | 8/1995 | Formon et al. |
| 5,452,832 | A | 9/1995 | Niada |
| 5,630,526 | A | 5/1997 | Moody |
| 5,657,945 | A | 8/1997 | Bryant |
| 5,691,919 | A | 11/1997 | Gemmell et al. |
| 5,692,313 | A | 12/1997 | Ikeda et al. |
| 5,772,291 | A | 6/1998 | Byrd et al. |

(Continued)

FOREIGN PATENT DOCUMENTS

| | | |
|---|---|---|
| DE | 101 31 019 | 12/2002 |
| EP | 096 178 | 12/1983 |

(Continued)

*Primary Examiner* — William A Rivera
(74) *Attorney, Agent, or Firm* — Thomas R. Lampe

(57) ABSTRACT

Paper towel dispenser apparatus and method wherein one or more targets are connected to a rotatable toweling support roller. A sensor senses capacitance changes caused by the rotating roller and the one or more targets and sends signals to a controller to control rotation of the roller.

16 Claims, 10 Drawing Sheets

(56) References Cited

U.S. PATENT DOCUMENTS

| | | | |
|---|---|---|---|
| 5,816,514 | A | 10/1998 | Duclos et al. |
| 5,878,381 | A | 3/1999 | Gemmell et al. |
| 6,012,664 | A | 1/2000 | Duclos et al. |
| 6,036,137 | A | 3/2000 | Myren |
| 6,047,894 | A | 4/2000 | Arends et al. |
| 6,079,305 | A | 6/2000 | Bloch et al. |
| 6,105,898 | A | 8/2000 | Byrd et al. |
| 6,112,631 | A | 9/2000 | VanAlstine |
| 6,119,523 | A | 9/2000 | Olsson et al. |
| 6,293,486 | B1 | 9/2001 | Byrd et al. |
| 6,363,824 | B1 | 4/2002 | Granger |
| 6,412,655 | B1 | 7/2002 | Stuetzel et al. |
| 6,412,679 | B2 | 7/2002 | Formon et al. |
| 6,419,136 | B2 | 7/2002 | Formon et al. |
| 6,439,068 | B2 | 8/2002 | Windolph |
| 6,446,901 | B1 | 9/2002 | Haen et al. |
| 6,592,067 | B2 | 7/2003 | Denen et al. |
| 6,695,246 | B1 | 2/2004 | Elliott et al. |
| 6,820,785 | B2 | 11/2004 | Kapiloff |
| 6,854,684 | B2 | 2/2005 | Byrd et al. |
| 6,892,620 | B2 | 5/2005 | Kapiloff |
| 6,977,588 | B2 | 12/2005 | Schotz et al. |
| 6,988,689 | B2 | 1/2006 | Thomas et al. |
| 7,044,421 | B1 | 5/2006 | Omdoll et al. |
| 7,168,602 | B2 | 1/2007 | Broehl |
| 7,182,288 | B2 | 2/2007 | Denen et al. |
| 7,256,957 | B1 | 8/2007 | Rahgozar |
| 7,296,765 | B2 | 11/2007 | Rodrian |
| 7,301,350 | B2 | 11/2007 | Hargreaves et al. |
| 7,325,767 | B2 | 2/2008 | Elliott et al. |
| 7,325,768 | B2 | 2/2008 | Byrd et al. |
| 7,341,170 | B2 | 3/2008 | Boone |
| 7,354,015 | B2 | 4/2008 | Byrd et al. |
| 7,398,944 | B2 | 7/2008 | Lewis et al. |
| 2004/0173440 | A1* | 9/2004 | Mauch et al. ..... 198/781.05 |
| 2004/0251375 | A1* | 12/2004 | Denen et al. ..... 242/563 |
| 2005/0011987 | A1* | 1/2005 | Lemaire et al. ..... 242/563 |
| 2005/0145745 | A1* | 7/2005 | Lewis et al. ..... 242/563 |
| 2007/0079526 | A1 | 4/2007 | Volkers |
| 2007/0099189 | A1 | 5/2007 | Gomez-Elvira Rodriguez et al. |
| 2008/0087758 | A1* | 4/2008 | Formon et al. ..... 242/563 |
| 2008/0309380 | A1 | 12/2008 | Yang et al. |

FOREIGN PATENT DOCUMENTS

| | | |
|---|---|---|
| JP | 2003-187410 | 7/2003 |
| KR | 10-2005-021832 | 3/2005 |
| WO | WO 9959457 | 11/1999 |
| WO | WO 00/63100 | 10/2000 |
| WO | WO 0063100 | 10/2000 |

* cited by examiner

Processor Board
Linear Regulator
Power 2 Processor Board Flex
Vout = 600mV x (1 + R12/R8)
Install R8 & R12 if using Adjustable Version
U1
LT3009ESC6-3.3@PBF
U2
PIC16F723
J5
1.0-WT/8P
PROX SENSE
DRN SENSE
CK SENSE
VBAT
+3V3
TP20
TP19
D605
MOTOT PN
S SENSE
L SENSE
MCLR
SPDAT
SPCLK Towel Length Selector Matrix
S SENSE
L SENSE
Towel Length
Short (12')
Medium (18")
Long (24")

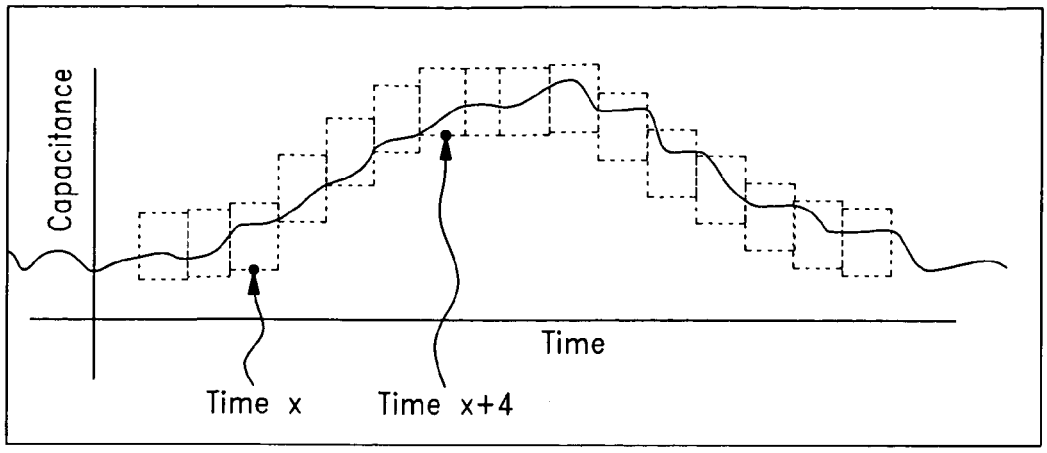
*Fig. 14*
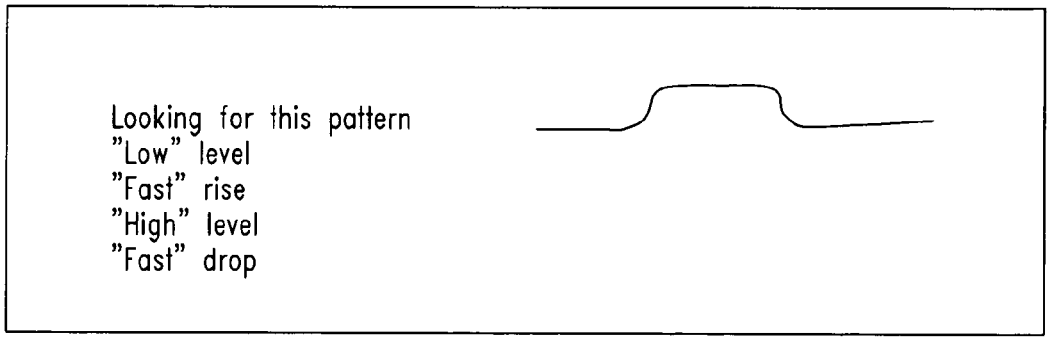
*Fig. 15*
| | | | | | | | | | | | | | | | | | | | | | | | |
|---|---|---|---|---|---|---|---|---|---|---|---|---|---|---|---|---|---|---|---|---|---|---|---|
| "X" | "X" | "X" | "X" | "X" | "X" | "X" | > +5 | > +5 | > +5 | > +5 | > +5 | -2/ +2 | -2/ +2 | -2/ +2 | -2/ +2 | < -5 | < -5 | < -5 | < -5 | < -5 | "X" | "X" | "X" |
*Fig. 16*
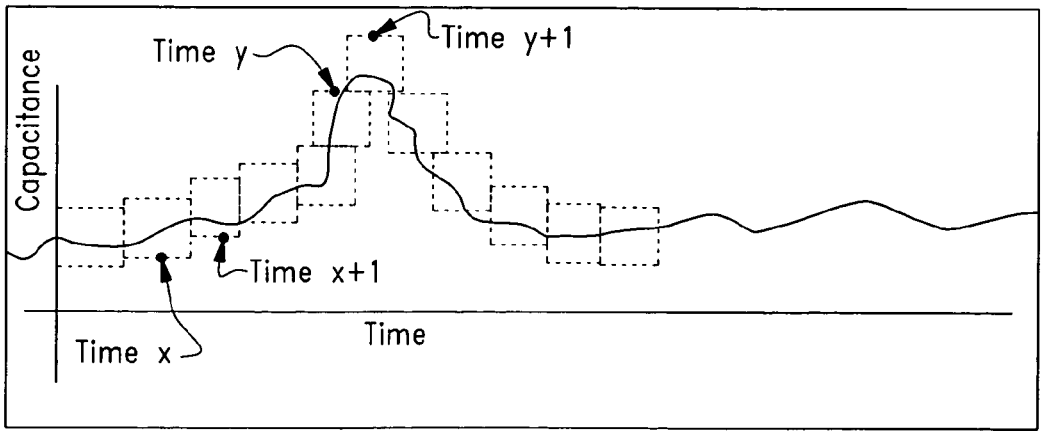
*Fig. 17*

PAPER TOWEL DISPENSING SYSTEMS

This application includes a computer program listing Appendix in the form of a compact disc (two identical copies). The files of the compact disc are specified in an Attachment located at the end of the specification and before the claims hereof.

TECHNICAL FIELD

This invention relates to a paper towel dispensing system, and more particularly to an apparatus and method wherein capacitive sensing technology senses positioning of a toweling support roller and rotation of the toweling support roller is controlled based on capacitance sensing.

BACKGROUND OF THE INVENTION

Many dispenser systems are known in the prior art for dispensing paper toweling from rolls thereof. In some cases, the paper toweling is comprised of individual paper towel segments separated by perforated tear lines, and in others the toweling has no perforated tear lines formed therein, severing or cutting individual sheets from the toweling accomplished by some suitable severing structure incorporated in the dispenser.

Many paper towel dispensing cabinets employ motor driven toweling support rollers or drums to transport toweling during the dispensing operation. Rotation of the rollers is accomplished in a variety of ways, including mechanical switching associated with the roller or by employing electronic methods to control motor "on" time and control roller rotation. Such arrangements include both dispensers which are manually actuated, as by means of a push button, and those employing a sensor, such as a sensor sensing proximity of a user's hand, to initiate operation.

U.S. Pat. No. 6,820,785, issued Nov. 23, 2004, discloses an electro-mechanical roll towel dispenser including a housing with a roll carrier disposed therein to rotatably support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing and a second electrical operational mode wherein a measured length of a next sheet is automatically fed from the housing to define the tail for the next user.

The dispenser of U.S. Pat. No. 6,820,785 includes a sensor for detecting a parameter that is changed by an initial pull exerted on a tail of a web of material extending from the opening of the dispenser. The sensor also generates a signal sent from the sensor to a control circuit or circuitry causing the motor employed in the apparatus to drive the feed mechanism until a measured length of web material that includes the tail of web material has been fed from the dispenser in the form of a measured sheet for subsequent removal by the user.

Similar devices are disclosed in U.S. Pat. No. 3,730,409 and Patent Publication Document WO 00/63100. The devices of these latter two documents have sensors for detecting movement of a tail end of web material such that the feed mechanism is activated in response to detecting the movement.

It is known to use magnets and a sensor (Hall effect sensors or reed switches) to control rotation of a roller or drum to control the amount of dispensed toweling. By placing a magnet in a specific location on the roller, and a magnet sensor nearby, it is possible to count the revolutions of the roller. The drawbacks of this method include relatively high manufacturing expense, since magnets and sensors are expensive. Also, multiple magnets are required when one revolution of the roller does not provide sufficient control of the dispensed material.

Another traditional method is to use timers to control the length of time the motor driving the roller is energized. The primary drawback of this approach is that it requires significant and ongoing calibration due to variability of power source to the motor and variability in the mechanical structure ("friction" is variable).

The following documents are also believed to be representative of the current state of the prior art in this field: U.S. Pat. No. 3,715,085, issued Feb. 6, 1973, U.S. Pat. No. 3,730,409, issued May 1, 1973, U.S. Pat. No. 3,737,087, issued Jun. 5, 1973, U.S. Pat. No. 3,949,918, issued Apr. 13, 1976, U.S. Pat. No. 3,998,308, issued Dec. 21, 1976, U.S. Pat. No. 4,666,099, issued May 19, 1987, U.S. Pat. No. 4,676,131, issued Jun. 30, 1987, U.S. Pat. No. 4,721,265, issued Jan. 26, 1988, U.S. Pat. No. 4,738,176, issued Apr. 19, 1988, U.S. Pat. No. 4,790,490, issued Dec. 13, 1988, U.S. Pat. No. 4,796,825, issued January 1989, U.S. Pat. No. 4,960,248, issued Oct. 2, 1990, U.S. Pat. No. 5,131,302, issued Jul. 21, 1992, U.S. Pat. No. 5,452,832, issued Sep. 26, 1995, U.S. Pat. No. 5,772,291, issued Jun. 30, 1998, U.S. Pat. No. 6,079,305, issued Jun. 27, 2000, U.S. Pat. No. 6,105,898, issued Aug. 22, 2000, U.S. Pat. No. 6,412,655, issued Jul. 2, 2002, U.S. Pat. No. 6,412,679, issued Jul. 2, 2002, Patent Document No. WO 9959457, dated November 1999, Patent Document No. WO 0063100, dated October 2000, U.S. Pat. No. 7,398,944, issued Jul. 15, 2008, U.S. Pat. No. 6,892,620, issued May 17, 2005, U.S. Pat. No. 7,044,421, issued May 16, 2006, U.S. Pat. No. 4,573,750, issued Mar. 4, 1986, U.S. Pat. No. 4,826,262, issued May 2, 1989, U.S. Pat. No. 6,446,901, issued Sep. 10, 2002, U.S. Pat. No. 4,270,818, issued Jun. 2, 1981, U.S. Pat. No. 6,112,631, issued Sep. 5, 2000, U.S. Pat. No. 5,375,920, issued Dec. 27, 1994, U.S. Pat. No. 7,354,015, issued Apr. 8, 2008, U.S. Pat. No. 4,738,176, issued Apr. 19, 1988, U.S. Pat. No. 4,790,490, issued Dec. 13, 1988, U.S. Pat. No. 6,079,305, issued Jun. 27, 2000, U.S. Pat. No. 6,419,136, issued Jul. 16, 2002, U.S. Pat. No. 6,412,679, issued Jul. 2, 2002, U.S. Pat. No. 5,441,189, issued Aug. 15, 1995, U.S. Pat. No. 5,878,381, issued Mar. 2, 1999, U.S. Pat. No. 5,691,919, issued Nov. 25, 1997, U.S. Pat. No. 5,452,832, issued Sep. 26, 1995, U.S. Pat. No. 5,340,045, issued Aug. 23, 1994, U.S. Pat. No. 5,335,811, issued Aug. 9, 1994, U.S. Pat. No. 5,244,263, issued Sep. 14, 1993, U.S. Pat. No. 4,848,854, issued Jul. 18, 1989, U.S. Pat. No. 4,738,176, issued Apr. 19, 1988, U.S. Pat. No. 4,270,818, issued Jun. 2, 1981, U.S. Pat. No. 4,170,390, issued Oct. 9, 1979, U.S. Pat. No. 5,657,945, issued Aug. 19, 1997, U.S. Pat. No. 4,122,738, issued Oct. 31, 1978, U.S. Pat. No. 6,012,664, issued Jan. 11, 2000, U.S. Pat. No. 5,816,514, issued Oct. 6, 1998, U.S. Pat. No. 5,417,783, issued May 23, 1995, U.S. Pat. No. 4,717,043, issued Jan. 5, 1988, U.S. Pat. No. 5,630,526, issued May 20, 1997, U.S. Pat. No. 6,363,824, issued Apr. 2, 2002, U.S. Pat. No. 6,293,486, issued Sep. 25, 2001, U.S. Pat. No. 6,695,246, issued Feb. 24, 2004, U.S. Pat. No. 6,854,684, issued Feb. 15, 2005, U.S. Pat. No. 6,988,689, issued Jan. 24, 2006, U.S. Pat. No. 7,325,767, issued Feb. 5, 2008, U.S. Pat. No. 7,325,768, issued Feb. 5, 2008, U.S. Pat. No. 7,168,602, issued Jan. 30, 2007, U.S. Pat. No. 6,592,067, issued Jul. 15, 2003, U.S. Pat. No. 7,341,170, issued Mar. 11, 2008, U.S. Pat. No. 7,182,288, issued Feb. 27, 2007, U.S. Pat. No. 7,296,765, issued Nov. 20, 2007, U.S. Pat. No. 6,977,588 issued Dec. 20, 2005 and U.S. Pat. No. 6,820,785, issued Nov. 23, 2004.

As will be seen below, the system of the present invention utilizes the unique approach of employing targets on a paper toweling support roller sensed by capacitance sensor structure during rotation of the roller, the capacitance sensor structure sensing capacitance changes caused by the rotating targets. Use of the approach of this invention allows control of paper length, prevents of motor jams and turns the motor control on and off based on capacitance sensing.

A search of the prior art relating to employment of capacitance sensing techniques, including in systems utilizing rotating drums located the following patent documents: U.S. Pat. No. 6,036,137, issued Mar. 14, 2000, U.S. Pat. No. 5,692,313, issued Dec. 2, 1997, U.S. Patent Application Pub. No. US 2007/0099189, pub. May 3, 2007, U.S. Patent Application Pub. No. US 2007/0079526, pub. Apr. 12, 2007, Foreign Patent documents: JP 2003-187410, KR 10-2005-021832, DE 101 31 019, EP 096 178, U.S. Pat. No. 6,047,894, issued Apr. 11, 2000, U.S. Pat. No. 4,448,196, issued May 15, 1984, U.S. Pat. No. 7,256,957, issued Aug. 14, 2007, U.S. Pat. No. 6,439,068, issued Aug. 27, 2002, U.S. Patent Pub. No. US 2008/0309380, pub. Dec. 18, 2008, U.S. Pat. No. 6,119,523, issued Sep. 19, 2000, U.S. Pat. No. 5,351,685, issued Oct. 4, 1994, U.S. Pat. No. 7,301,350, issued Nov. 27, 2007.

The systems disclosed in the located prior art do not remotely relate to paper towel dispensers. There is no teaching or suggestion of the unique combinations of structural components or method steps disclosed and claimed herein.

DISCLOSURE OF INVENTION

The present invention encompasses a paper towel dispenser apparatus for dispensing paper toweling from a roll of paper toweling.

The apparatus includes a housing and a roll support within the housing for supporting a roll of paper toweling.

A rotatable toweling support roller is located within the housing for receiving paper toweling from the roll of paper toweling and transporting the paper toweling.

An electric motor is operatively associated with the toweling support roller for rotating the toweling support roller.

At least one target is operatively associated with the rotatable toweling support roller and movable responsive to rotation of the rotatable toweling support roller by the electric motor.

Capacitance sensor structure is operatively associated with the electric motor. A controller is employed for receiving signals from the capacitance sensor structure for controlling rotation of the rotatable toweling support roller by the electric motor responsive to capacitance changes caused by movement of the at least one target sensed by the capacitance sensor structure.

The invention also encompasses a method of dispensing paper toweling from a roll of paper toweling from dispenser apparatus including a housing, a roll support within the housing, a rotatable toweling support roller within the housing and an electric motor for rotating the toweling support roller.

The method includes the step of operatively connecting at least one target to the rotatable toweling support roller. While toweling from the roll is located on the rotatable toweling support roller, the electric motor is employed to rotate the toweling support roller and the at least one target to transport the paper toweling.

Sensor structure is employed in operative association with the electric motor to sense capacitance changes caused by movement of the at least one target.

Signals from the sensor structure representative of the capacitance changes sensed by the sensor structure and representative of target movement are directed to a controller.

The controller is employed to control rotational movement of the rotatable toweling support roller responsive to the signals received by the controller from the sensor structure.

Other features, advantages and objects of the present invention will become apparent with reference to the following description and accompanying drawings.

BRIEF DESCRIPTION OF DRAWINGS

FIGS. 13 and 14 are diagrammatic illustrations relating to the method of the present invention;

FIG. 15 is a representation of an exemplary pattern searched by the algorithm of the method;

FIG. 16 illustrates the pattern of FIG. 5 in a linear representation;

FIG. 17 is a diagrammatic illustration showing the principles of operation of a multi-sample delta method in accordance with the teachings of the present invention;

MODES FOR CARRYING OUT THE INVENTION

Figure 2:
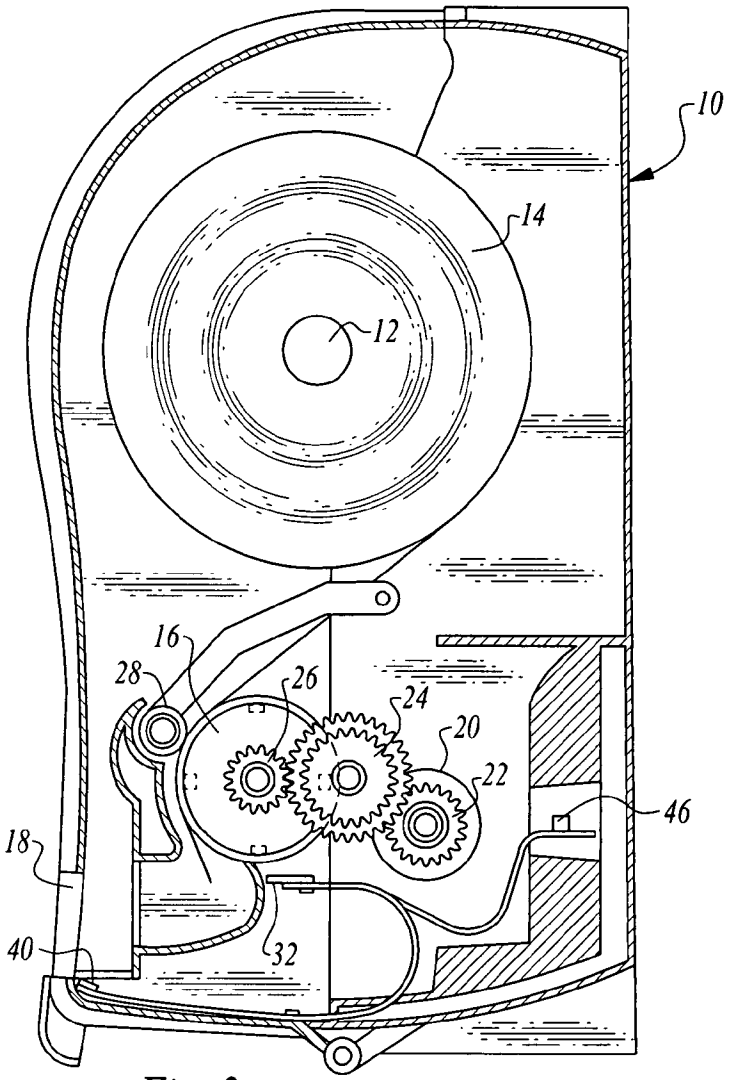
FIG. 2 is a cross-sectional view illustrating the interior of the dispenser with toweling from a roll of paper toweling positioned on a rotatable toweling support roller.
Figure 1:
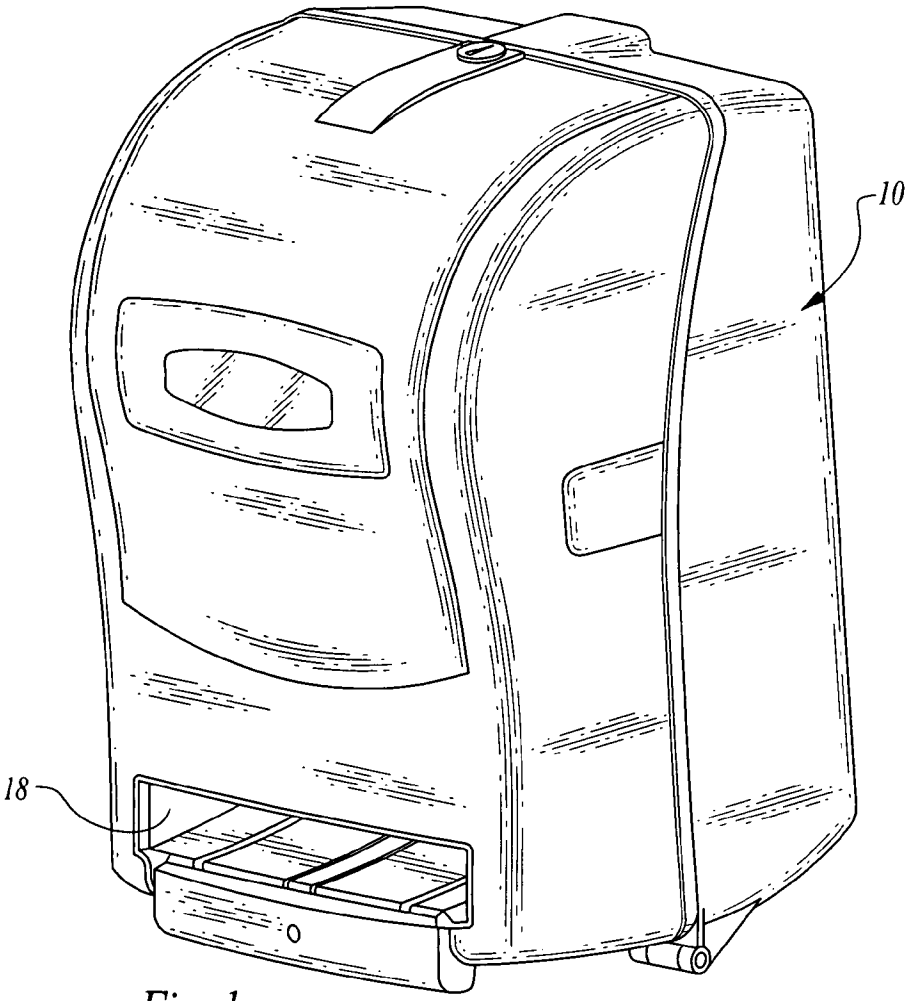
FIG. 1 is a frontal, perspective view illustrating the outside of a paper towel dispenser constructed in accordance with the teachings of the present invention.

Referring now to the drawings, paper toweling dispenser apparatus constructed in accordance with the teachings of the present invention is illustrated. The apparatus is for dispensing paper toweling from a roll of paper toweling.

The dispenser includes a housing 10 defining an interior. A roll support 12 of any suitable construction is located within the housing. FIG. 2 shows a roll of paper toweling 14 supported by the roll support. The roll support may be of any suitable type employed in paper towel dispensers.

Rotatably mounted within the housing 10 is a rotatable toweling support roller 16 which is positioned below roll of paper toweling 14 and receives and supports unwound toweling, as shown. Dispensed toweling exits opening 18 formed in the front of the housing or cabinet. Any suitable means may be utilized to sever individual sheets from the toweling during dispensing, for example a cutter blade located at or near the opening 18 or elsewhere in the path of the dispensed toweling. In the interest of simplicity and due to the fact that such expedients are well known, a cutter blade has not been illustrated.

An electric motor 20 having a motor shaft is positioned in the housing, the motor shaft having a gear 22 which meshes with a set of gears 24 to drive a gear 26 affixed to roller 16 for rotation therewith. A pinch roll 28 maintains the tail end of the toweling in firm engagement with the surface of the roller 16.

The toweling support roller 16 has a pair of targets operatively associated therewith and movable responsive to rotation of the rotatable toweling support roller by the electric motor. More particularly, in the arrangement illustrated, roller 16 has a pair of strips 30 extending along the complete (or partial) length thereof and in diametric opposition to one another. The strips are formed of any suitable metallic material and may be solid metal or adhesive foil for example, the material preferably being strongly dielectric. Any suitable sensor material may be utilized without departing from the spirit or scope of this invention as long as it allows capacitance sensing during rotation of the roller.

Figure 3:
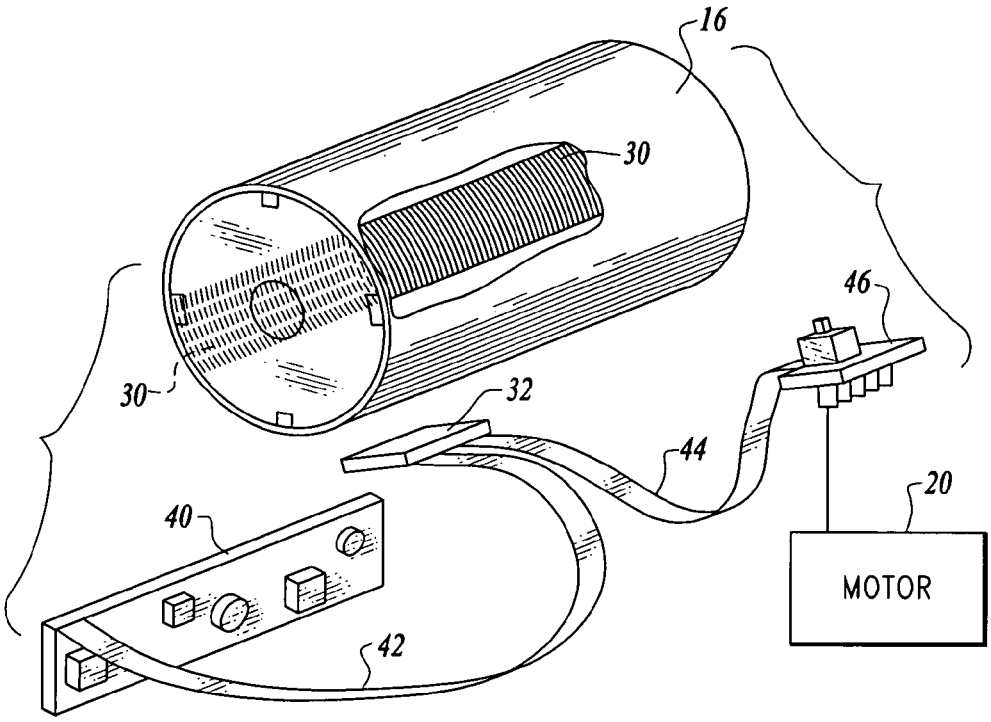
FIG. 3 is an exploded, diagrammatic view illustrating targets located on the roller and selected structural elements relating to the sensing of capacitance changes caused by the rotating roller and control structure for controlling operation of an electric motor utilized to rotate the roller.
Figure 4:
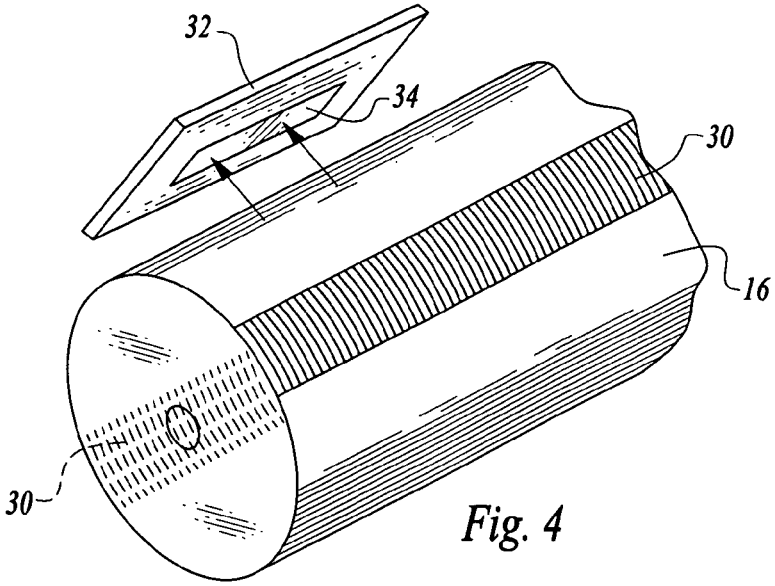
FIG. 4 is a diagrammatic view of the roller, targets and processor printed circuit board with sensor pad.

The strips 30 may suitably be covered, as shown in FIG. 3, by a material such as over molded rubber. Such material not only provides a good slip free surface for supporting toweling, but also serves the purpose of maintaining the sensor targets in place. FIG. 4 illustrates the strips being uncovered, which also may be suitable.

Located within housing 10 and positioned closely adjacent to the peripheral surface of roller 16 is a processor printed circuit board 32 which includes a capacitance sensor 34 of any suitable type. It will be appreciated that the processor can be located virtually anywhere, potentially even including outside the housing. Also, the processor and sensor do not have to be incorporated on the same printed circuit board. In addition, the sensor itself does not have to be on a printed circuit board either. It can, in principle, be fashioned exclusively from wire or e.g. flex cable, which is another potential advantage.

Figures 10, 10A, 10B:
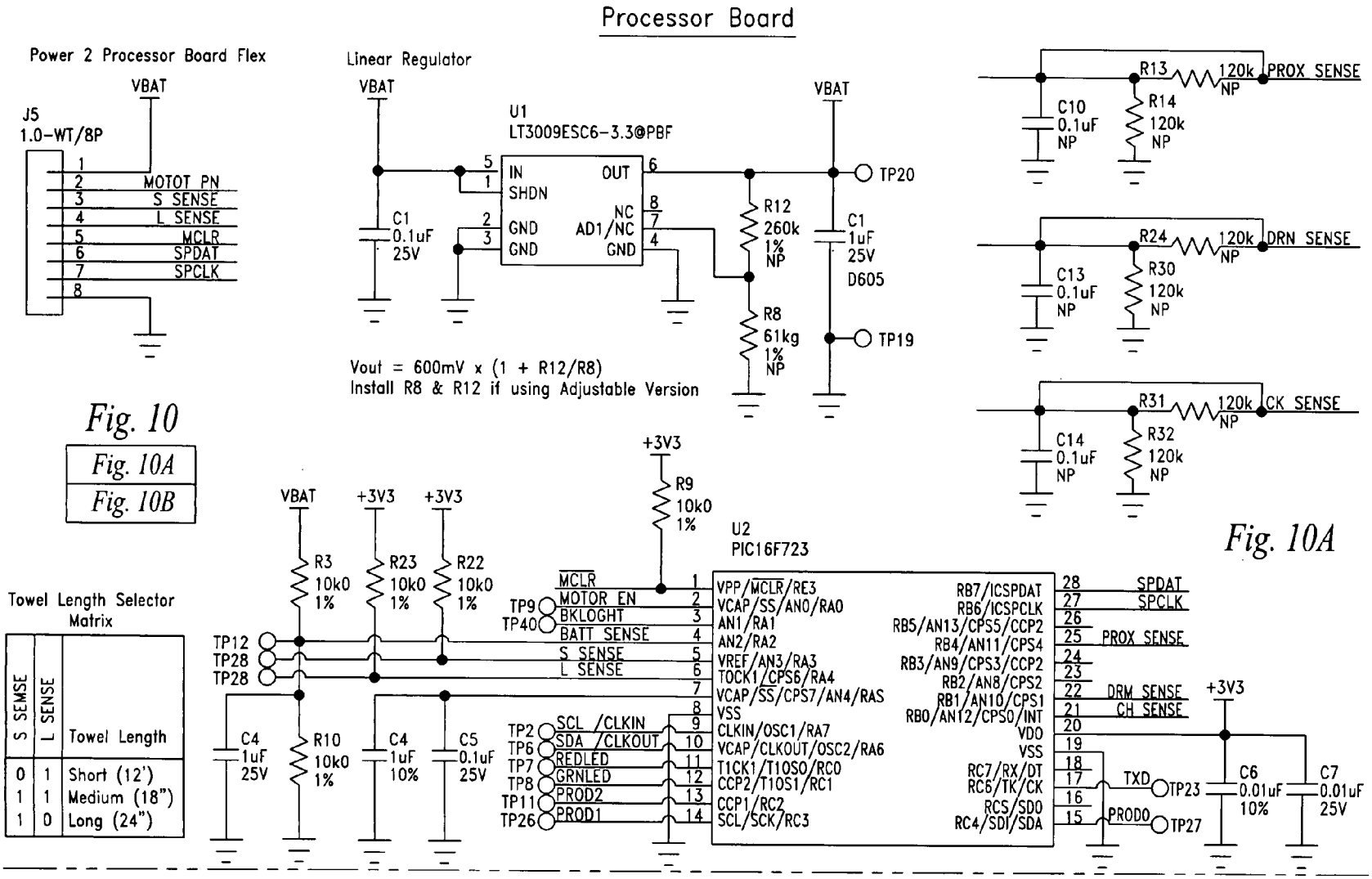
FIGS. 10 (10A and 10B) is a schematic diagram relating to a processor printed circuit board incorporating a capacitance change sensor.
Figure 10B:
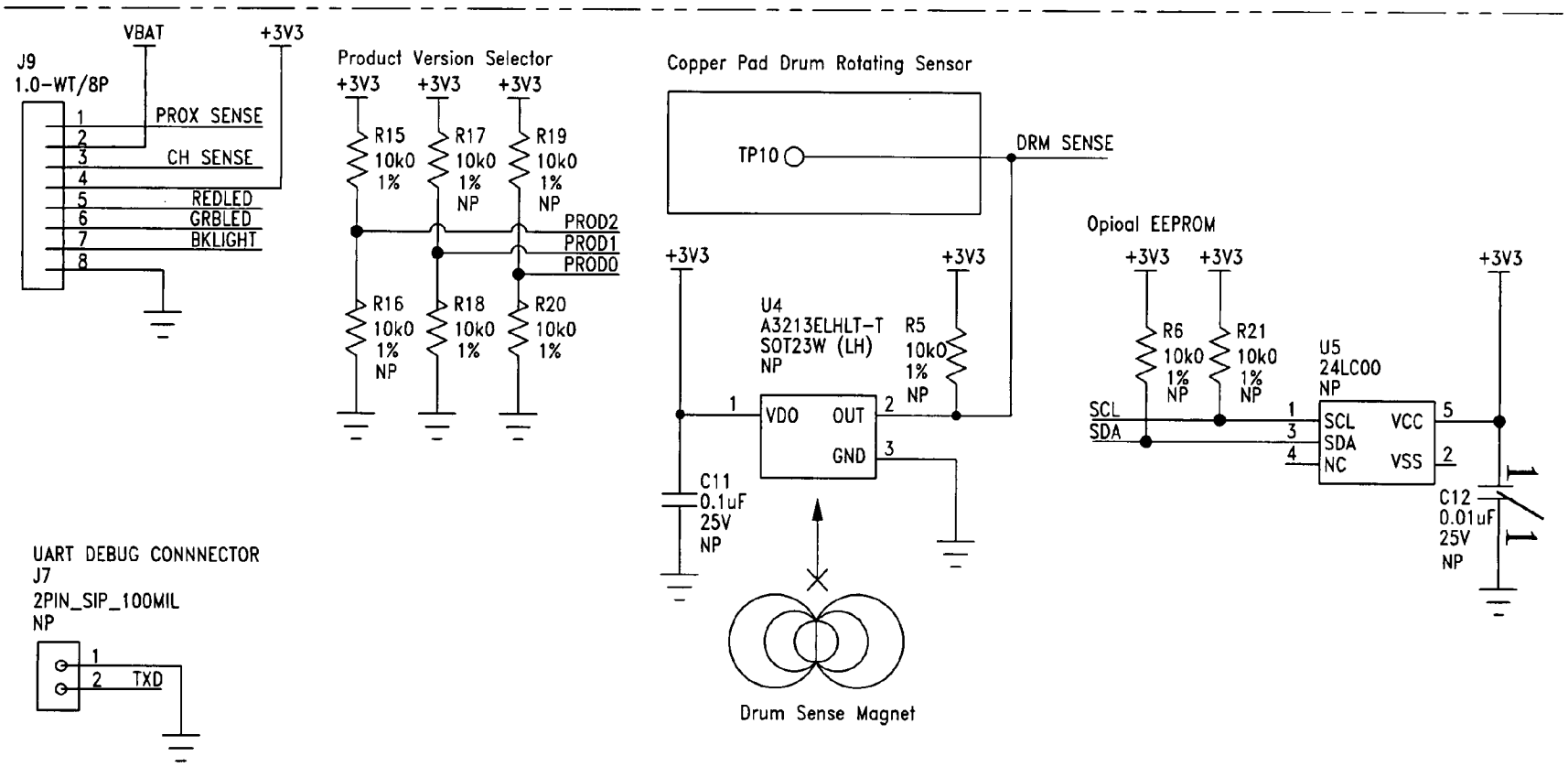

FIG. 10 illustrates schematics of a processor board that may be utilized to control roller rotation. Portions of the processor schematics are shown in FIGS. 10A and 10B.

The arrangement disclosed allows complete software control. There are no mechanical switches or other components that can wear or fail. Two CD copies of such software is attached to this application as an Appendix.

By inserting metal sensor targets into the drum assembly of the dispenser, one is able to "see" the sensor targets and the spaces between them as a rotational count, providing a window of four counts (two targets and two spaces). The sensor may suitably be statically located at the paper guide just below the rotating paper toweling support roller within range of sensing the capacitance changes as the drum rotates.

It is possible to use one sensor board for'both proximity detection and drum roller control. There can be real cost savings with such an approach. The general principle is that the micro controller has an algorithmic means of deciding when to treat the one sensor as a proximity detector and when to treat it as a drum roller controller, and applies different delta math in each case.

As will be described in greater detail below, software allows one to count the on/off patterns of the rotating drum, producing the logical control for the processor to know where the drum was and how far it had rotated. By controlling the amount of rotation, one can calculate paper lengths with a predetermined formula embedded into the firmware. One can also detect the performance of the motor and disconnect power if the PCB does not see the drum within specified time frames during rotation.

Figure 9:
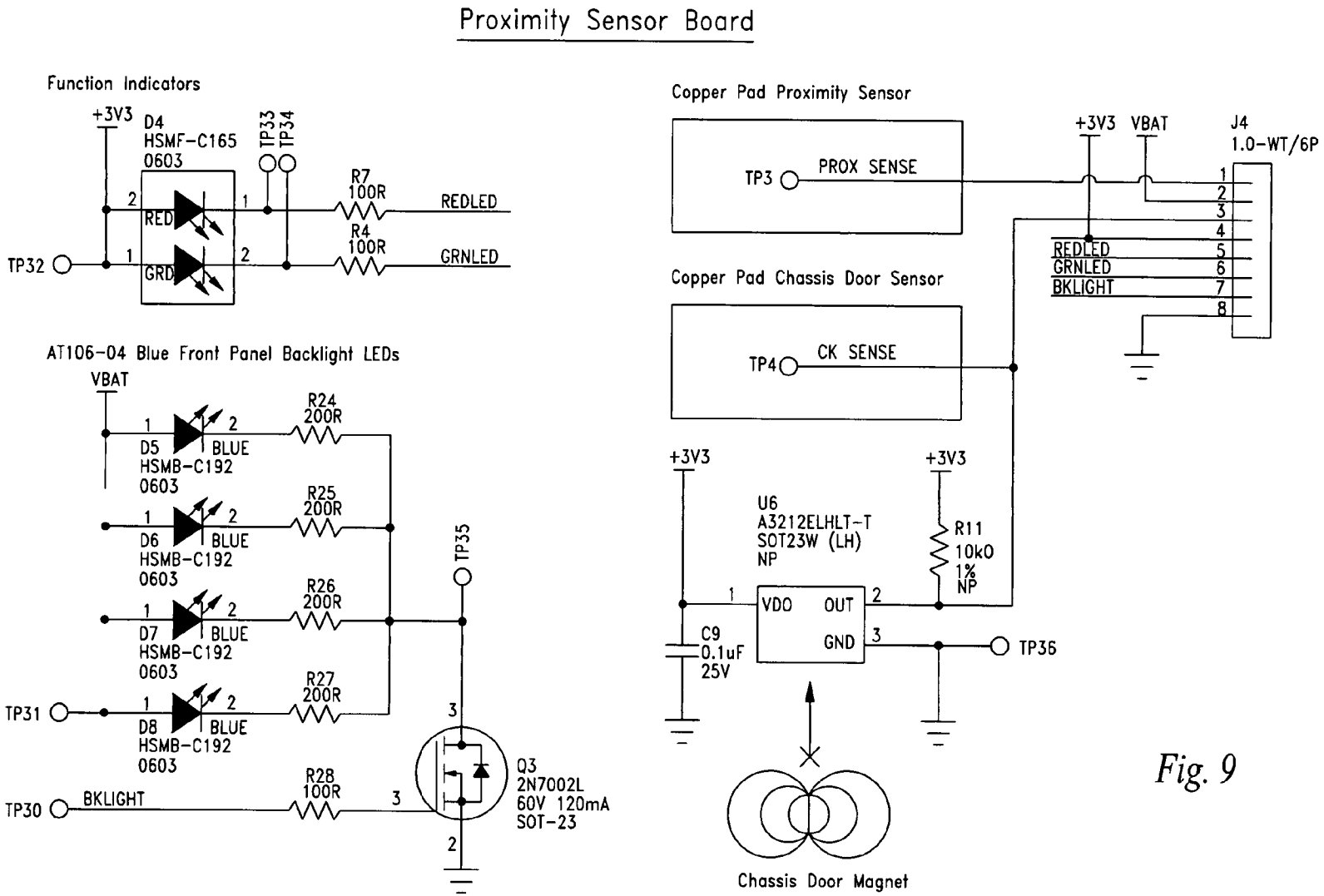

In the illustrated embodiment, a proximity sensor printed circuit board 40 is located at the front of housing 10 and connected via a flat flexible cable 42 to processor printed circuit board 32, the circuitry of which is shown in FIG. 9. This arrangement includes a proximity sensor that senses the presence of a hand or other object near the housing. As noted above, a single sensor board may be utilized for both proximity detection and roller control. A closed door sensor is also incorporated in the circuitry of FIG. 9 to allow actuation only if the cabinet or housing door is closed.

Figure 8:
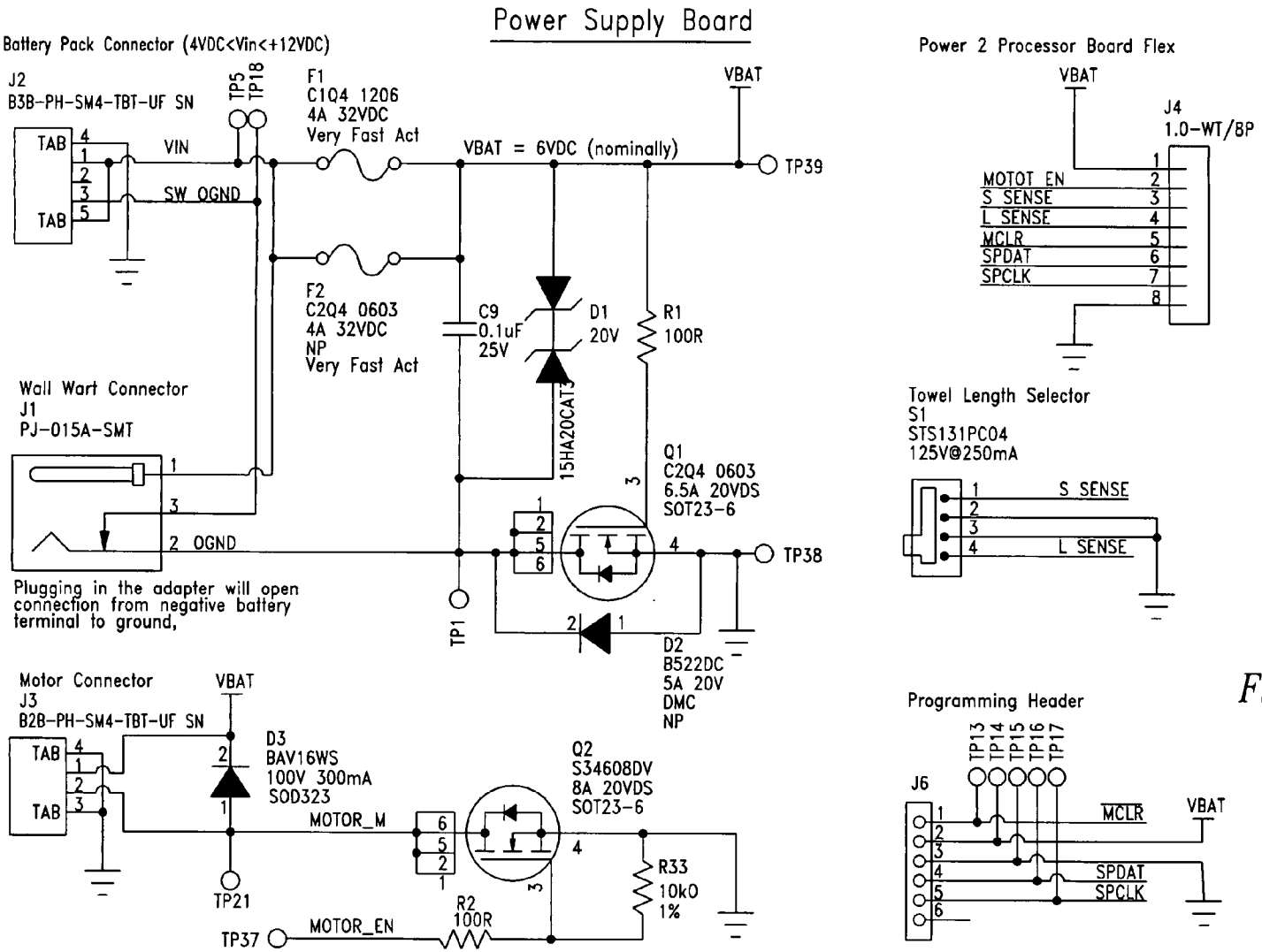
FIGS. 8 and 9 respectively disclose schematics of a power supply printed circuit board and a proximity sensor printed circuit board utilized in the dispenser apparatus of this invention.

A flat flexible cable 44 connects processor printed circuit board 32 to power supply printed circuit board 46. FIG. 8 illustrates the schematic of PCB 46. The circuitry includes a towel length selector that enables different alternative sheet lengths to be dispensed by the apparatus. As noted above, by controlling the amount of rotation of the paper toweling support roller, one can calculate and provide different paper towel lengths employing a predetermined formula embedded into the firmware of the apparatus.

Figure 5:
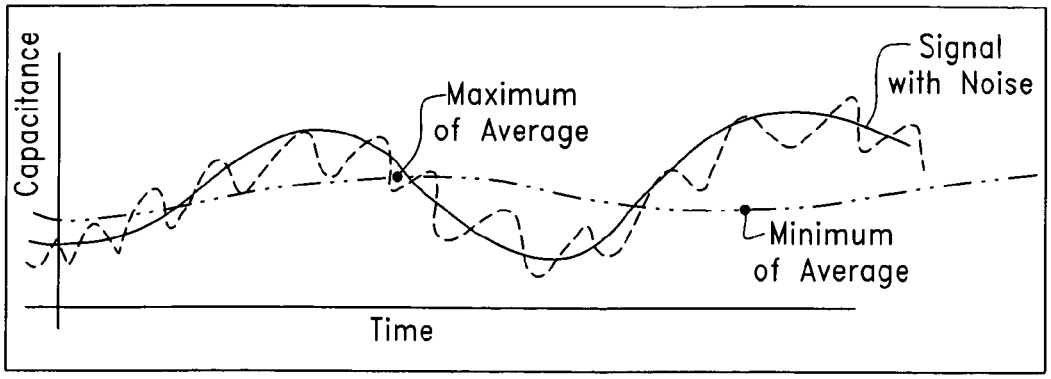
Fig. 5 (Prior Art)
FIG. 5 illustrates a traditional prior art approach of dealing with capacitance sensed signals by smoothing or averaging them.

Using capacitance sensing for tracking a rotating or otherwise periodically moving object poses challenges. The traditional approach to dealing with capacitance sensed signals is to smooth out or average them as shown in the capacitance/time graph or diagram of FIG. 5. The solid line is the base line with the noise superimposed depicted by a dash line. The dot-line is the smooth average.

For a rotating device of circular shape, the signal generated should generally be expressed as sine wave or other essentially periodic waveform of relatively stable frequency. To detect a specific point on the rotating cylinder (roller) passing near the sensor, then it is only necessary to search for a peak value.

However, with noise it is possible that the peak value with negative noise won't meet the value necessary to trigger a detection event. Or, a value with positive noise far from a peak event may be sufficient to trigger a false detection.

For this reason, the preferred approach for capacitance sensing of the targets and spaces therebetween on rotatable paper toweling support roller 16 is the capacitance sensing method sometimes referred to herein as the "delta method" or "delta detection method", which now will be described.

Figure 11:
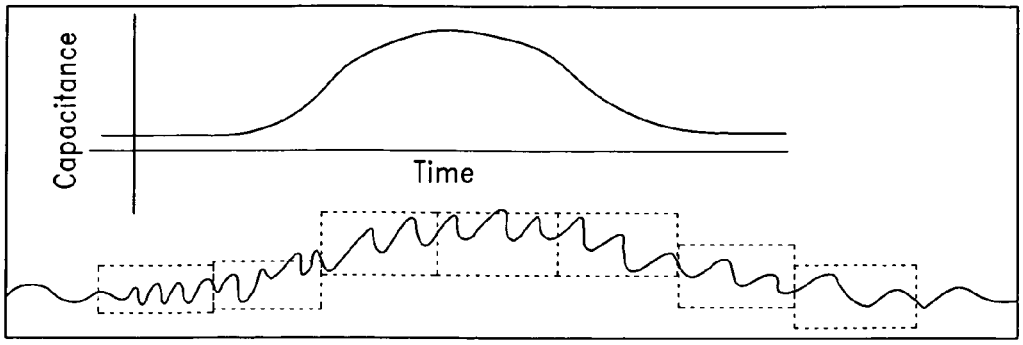
Fig. 11 (Prior Art)
FIG. 11 is a capacitance/time diagram illustrating the principles of operation of a conventional prior art detection approach.

With reference to FIG. 11, in order to better understand how the delta method differs from conventional detection methods, a brief explanation of a traditional approach that is commonly practiced for both analog and digital detection follows.

Each box depicted by dash lines in FIG. 11 represents a counting window, during which peaks from the sensor are counted and used as a proxy for the sensor's oscillation frequency. The length of the window is determined by the microcontroller's running frequency and a programmable internal timer.

The capacitance sensor forms what is essentially an antenna, and the oscillations from the sensor will not produce a single, stable frequency, but rather a noisy series of readings. One method for reducing the effect of the noise is to smooth out the signal (e.g. low-pass filter or average). This may be done with RC-type circuits in the analog domain or through signal processing in the digital domain. The smoothed out signal is depicted in FIG. 11 in a capacitance/time graph.

Figure 12:
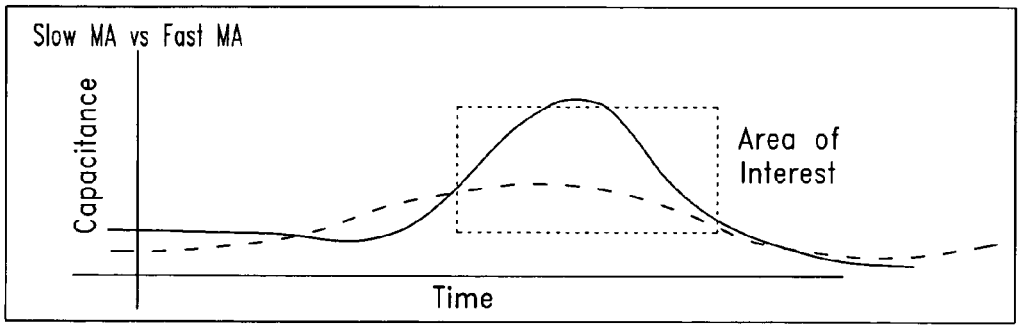
Fig. 12 (Prior Art)
FIG. 12 is a view similar to FIG. 1, illustrating the principles of operation of a second prior art detection method.

Multiple averages or different time-lengths may also be used. This is typically done by looking at times when an average of shorter time length crosses over or under an average of longer time length. This is shown in FIG. 12.

These methods have drawbacks for detecting short-duration events such as a hand wave. The FIG. 12 approach requires storage of two additional streams of numbers (one for each average). It is difficult to determine the "best" time lengths for averaging, as this changes with ambient noise levels. Undesirable latency between when an event happens and when it is detected can be introduced.

Figure 18:
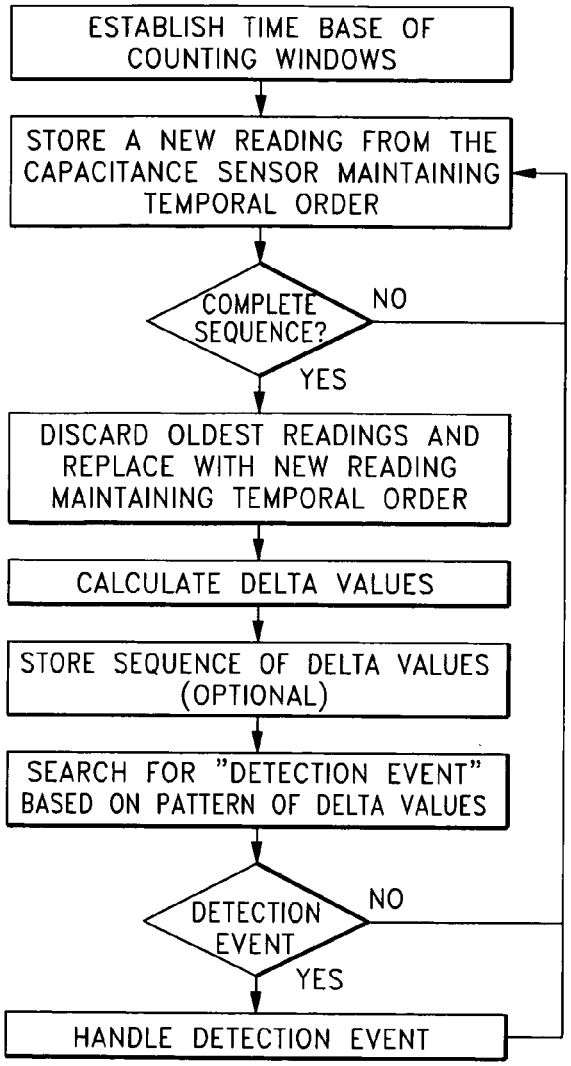
FIG. 18 is a block diagram showing sequential steps carried out when practicing the method of this invention.

The delta method is presented in block diagram form in FIG. 18 and is practiced utilizing coded software. Two CD copies of such software are attached as an Appendix.

Figure 13:
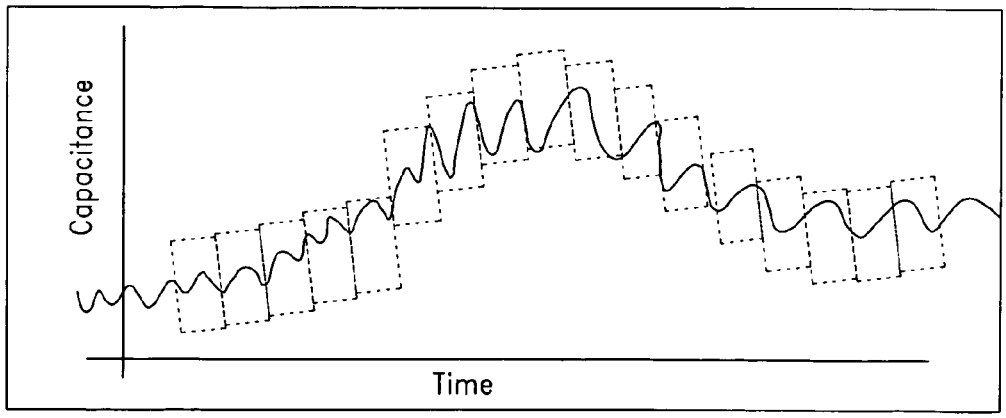

Utilizing the delta detection method, the starting point for processing data is the counting window. FIG. 13 shows relatively short counting windows applied to a single processing stream.

The sequence of readings is stored, usually in memory attached to a microcontroller or other programmable device. No averages need be computed, although the method will also work with both averaged and filtered readings. For example, well known techniques such as pre-filtering signals to eliminate 60 Hz noise are compatible with the proposed method. The method looks at the difference between readings taken at different points in time. These points in time may in fact be consecutive readings, or they may be separated by a set or arbitrary length of time, as depicted in FIG. 14.

Using this collected raw data, the processing then proceeds as follows. The difference or the delta between counting windows is calculated and this is stored in an array of delta values. The length of the array is a function of the type of event detected, and the noise signal.

If the raw frequency were to be plotted, this array of delta values could be considered a proxy for the second derivative of the raw frequency curve. A detection event now becomes a specific pattern in this second derivative.

One example of what the algorithm will search for, while maintaining an array of delta values of suitable length, or an array of readings upon which delta computations are performed at each time interval, is a pattern similar to a square wave pulse, such as depicted in FIG. 15. The pattern has a relatively flat "low" level, a sharp or "fast" rise from that "low" level, a short period of relative flatness at a "high" or elevated level, and a sharp drop from the elevated region. While this example illustrates a possible sequence of operations for a hand detection, many other types of events can be detected by changing the specific pattern being searched for.

In a linear representation, this pattern match will look similar to that shown in FIG. 16 wherein an "X" denotes a "don't care" value, and the other entries specify a range of acceptable values for that location in the array of delta values. A detection event then becomes a ratio of matching vs. non-matching values across the array of deltas values.

The comparison values may be stored as an explicit sequence of values, or stored implicitly as a part of the mathematical function that performs event detection.

In some applications, one delta calculation may be insufficient to establish a detection event. The delta method can be extended to use multiple samples, across arbitrary lengths of time, as illustrated in FIG. 17.

FIG. 17 exemplifies an implementation where the delta method has a look-back time of four samples and requires a specific relationship between two sets of delta calculations.

In this case, the reading at time (Y+1) is compared to the reading at time (X+1), and the reading at time (X) is compared to the reading at time (Y). The two comparisons may look for the same threshold, or they may be independent tests.

For example, for a very sharp change in the signal, the comparison between X and Y may look for a small change and a large change between (X+1) or (Y+1). Alternatively, a small change in a noisy environment may look for a moderate, identical change in both comparisons.

Multiple windows can also be used when storage space is limited, as more windows allow storage of smaller amounts of data.

The delta method technology can be effectively used to track roller 16 movement. A capacitance sensor 34 is mounted near the roller and metallic targets 30 are attached to the roller in a way that the sensor can read the target material and, as the target passes by the sensor, a detection event is recorded. The sensor may for example be a copper pad within printed circuit board 32.

Figure 6:
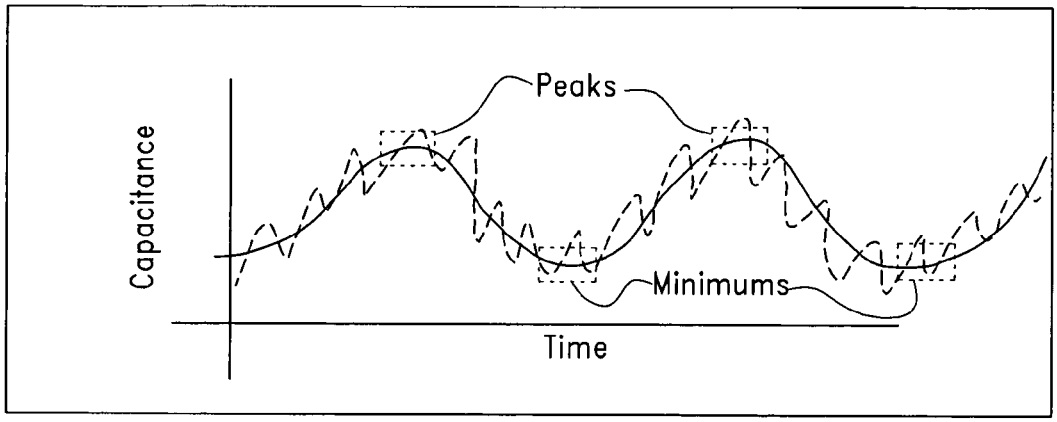
FIGS. 6 and 7 are capacitance/time diagrams illustrating approaches relating to the utilization of a delta detection method to sense capacitance changes.

The delta method for this particular application is the general delta method described above. The look-back distance between samples is a function of the sampling rate and the rotational speed of the roller. The counting window is small, to allow for multiple counts across the general maximum and minimum parts of the expected curve. See FIG. 6.

For random noise, this significantly increases the probability of detecting a peak while reducing the chance of a false positive. This is because a threshold value closer to the theoretical maximum distance between peaks and minimums can be used.

Figure 7:
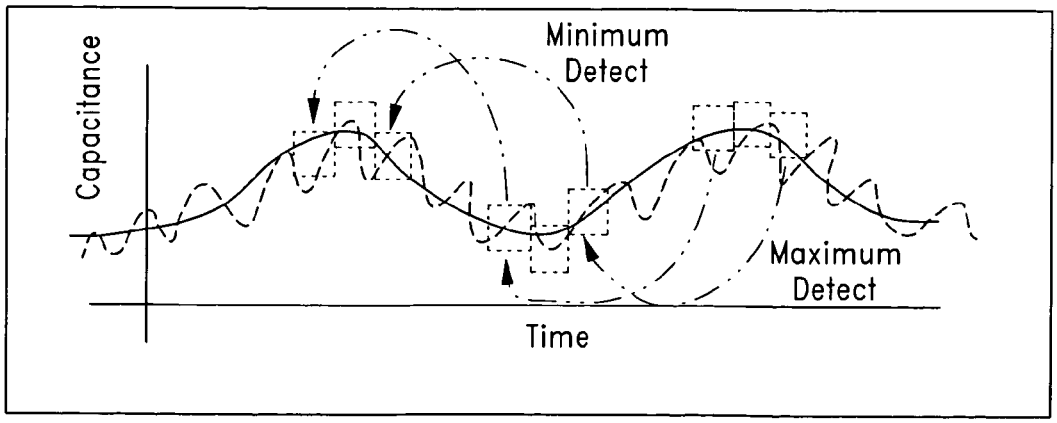

Two further variations or embodiments are proposed to deal with particularly challenging sensing environments as shown in FIG. 7.

The first variation uses multiple simultaneous deltas. This can be achieved in several ways, the simplest being to perform multiple comparisons at each point in time. With multiple comparisons, a detection event can be treated as a more complex "voting" scheme—e.g., two out of three delta compares meet a threshold.

The second variation is to detect both maximum and minimum values in the signal generated by the rotating object. This is shown in FIG. 7. This embodiment of the delta method alternates between searching for peaks and valleys. The operations can be considered inverse to each other: a peak may look for values above a high threshold; a valley may look for values below a low or negative threshold.

This is advantageous as it doubles the resolution at which the roller can be controlled, which allows for finer control of the quantity being dispensed by the roller or drum. The cost implications are obvious.

There may be implementations wherein the rotating roller spun by an electric motor, cannot maintain a constant rotational speed or cadence.

An example of how this can occur is in the case of a battery-powered motor, the batteries having been significantly depleted, cause a slowing rotation of the roller. In the case of a paper dispenser where the paper is stored on a large roll, the rotational speed may be different between a full roll (heavy) and a nearly depleted roll (light). A further example is the possible effect of friction of the mechanical structure changing as the dispenser is used over time.

Figure 19:
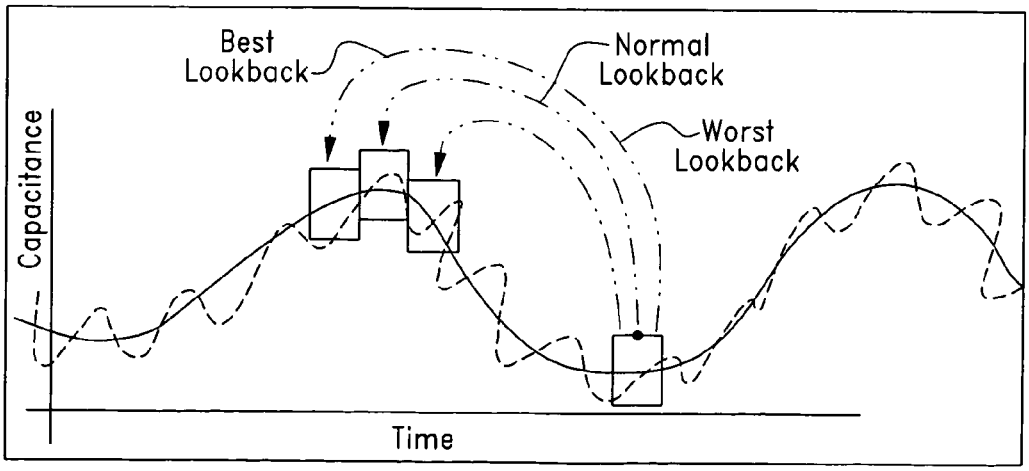
FIG. 19 is a capacitance/time diagram illustrating an approach relating to the utilization of a delta detection method to sense capacitance changes.

The delta method allows an approach for dealing with these variations in rotational speed. As shown in FIG. 19, the look-back distance for the delta calculation can be variable.

The variation of this look-back method distance is a function of the particular embodiment; for example, the look-back distance can be a function of the measured voltage at the battery terminals. Or the mechanical changes over time can be characterized, and the look-back distance can be calculated using an algorithm that understands the "aging" of the frictional resistance of the mechanical system.

The invention claimed is:

1. Paper towel dispenser apparatus for dispensing paper toweling from a roll of paper toweling, said apparatus comprising, in combination:

a housing;

a roll support within said housing for supporting a roll of paper toweling;

a rotatable toweling support roller having a cylindrically-shaped outer periphery within said housing for receiving paper toweling from the roll of paper toweling and transporting said paper toweling;

an electric motor operatively associated with said toweling support roller for rotating said toweling support roller;

targets spaced from one another and fixedly attached to said rotatable toweling support roller at the cylindrically-shaped outer periphery thereof and rotatable with said rotatable toweling support roller responsive to rotation of said rotatable toweling support roller by said electric motor, each said target comprising an element of metallic material extending at least partially along the length of said rotatable toweling support roller;

capacitance sensor structure operatively associated with said electric motor, said capacitance sensor structure located adjacent to and spaced from the cylindrically-shaped outer periphery of said rotatable toweling support roller for sensing capacitance changes caused by rotation of said elements of metallic material during rotation of said toweling support roller; and a controller including a programmed computer processor for receiving signals from said capacitance sensor structure for controlling rotation of said rotatable toweling support roller by said electric motor responsive to capacitance changes caused by movement of said targets sensed by said capacitance sensor structure.

2. The paper towel dispenser apparatus according to claim 1 wherein said targets are formed of substantially dielectric material.

3. The paper towel dispenser according to claim 1 wherein said capacitance sensor structure includes a sensor pad located closely adjacent to the periphery of said rotatable toweling support roller and spaced therefrom.

4. The paper towel dispenser apparatus according to claim 1 wherein said rotatable toweling support roller includes an outer layer of toweling engagement material, said targets being substantially covered by said outer layer of toweling engagement material.

5. The paper towel dispenser apparatus according to claim 1 wherein said programmed computer processor is for receiving signals from said capacitance sensor structure relating to the rotational positioning of the targets on said rotatable toweling support roller by said electric motor.

6. The paper towel dispenser apparatus according to claim 5 wherein said signals from said capacitance sensor structure comprise on/off patterns produced by said targets and the spaces therebetween during rotation of said rotatable toweling support roller.

7. The paper towel dispenser apparatus according to claim 6 wherein the signals from said capacitance sensor structure can generally be expressed as sine waves or other essentially periodic waveforms, said programmed computer processor being programmed to utilize a capacitance change delta detection technique to track rotational positioning of said rotatable toweling support roller.

8. The paper toweling dispenser apparatus according to claim 5 wherein said programmed computer processor is programmed to obtain alternative dispensing of different predetermined lengths of toweling by said toweling dispenser apparatus, said paper toweling dispenser apparatus additionally comprising a switch operatively associated with said controller enabling a user to alternatively select from said pre-determined lengths of paper.

9. A method of dispensing paper toweling from a roll of paper toweling from dispenser apparatus including a housing, a roll support within said housing, a rotatable toweling support roller having a cylindrically-shaped outer periphery within said housing and an electric motor for rotating said toweling support roller, said method comprising the steps of:

fixedly attaching targets to the cylindrically-shaped outer periphery of said rotatable toweling support roller at spaced locations thereon whereby said targets have spaces therebetween, each said target comprising an element of metallic material extending at least partially along the length of said rotatable toweling support roller;

while toweling from said roll of paper is located on said rotatable toweling support roller, employing said electric motor to rotate said toweling support roller and said targets to transport said paper toweling;

employing capacitance sensor structure operatively associated with said electric motor to sense capacitance changes caused by rotation of said rotatable toweling support roller and targets, said capacitance sensor structure located adjacent to and spaced from the cylindrically-shaped outer periphery of said rotatable toweling support roller;

directing signals from said capacitance sensor structure representative of the capacitance changes sensed by said sensor structure and representative of target movement to a controller including a programmed computer processor; and employing said controller to control rotational movement of said rotatable toweling support roller responsive to the signals received by said controller from said capacitance sensor structure.

10. The method according to claim 9 wherein said targets are formed of substantially dielectric material.

11. The method according to claim 9 wherein said capacitance sensor structure includes a sensor pad, said sensor pad being located closely adjacent to the periphery of said rotatable toweling support roller and spaced therefrom.

12. The method according to claim 9 wherein said rotatable toweling support roller includes an outer layer of toweling engagement material, said targets being substantially covered by said outer layer of toweling engagement material.

13. The method according to claim 9 including the step of employing said capacitance sensor structure to direct signals to said programmed computer processor relating to the rotational positioning of the targets on said rotatable toweling support roller by said electric motor.

14. The method according to claim 13 wherein said signals from said capacitance sensor structure comprise on/off patterns produced by said targets and the spaces therebetween during rotation of said rotatable toweling support roller.

15. The method according to claim 14 wherein the signals from said capacitance sensor structure approximate sine waves, said programmed computer processor being programmed to utilize a capacitance change delta detection technique to track rotational positioning of said rotatable toweling support roller.

16. The method according to claim 14 wherein said programmed computer processor is programmed to allow alternative dispensing of different pre-determined lengths of toweling by said toweling dispenser apparatus, said paper toweling dispenser apparatus additionally comprising a switch operatively associated with said controller enabling a user to alternatively select from said different pre-determined lengths of toweling.

* * * * *